US006062253A

United States Patent [19]

Hanel et al.

[11] Patent Number: 6,062,253

[45] Date of Patent: May 16, 2000

[54] APPARATUS FOR THE INTERMEDIATE STORAGE AND CONTROLLABLE RELEASE OF A PREDETERMINABLE QUANTITY OF WATER

[75] Inventors: Bernd Hanel, Felbach; Dieter Krist, Winnenden, both of Germany

[73] Assignee: E. Missel GmbH, Stuttgart, Germany

[21] Appl. No.: 08/911,090

[22] Filed: Aug. 14, 1997

[30] Foreign Application Priority Data

Feb. 21, 1996 [DE] Germany ..... 196 06 441
Feb. 18, 1997 [EP] European Pat. Off. ..... 97102605

[51] Int. Cl.[7] ..... F16L 5/00

[52] U.S. Cl. ..... 137/360; 137/375; 137/391; 251/50

[58] Field of Search ..... 137/391, 375, 137/357, 360; 251/50, 52

[56] References Cited

U.S. PATENT DOCUMENTS 914,587 3/1909 Longstreet ..... 251/50
1,667,090 4/1928 Wallace ..... 137/391
2,440,006 4/1948 Donaldson ..... 137/391
3,095,005 6/1963 Thompson ..... 137/391
3,211,170 10/1965 White ..... 137/391
4,601,071 7/1986 Persson ..... 137/391
5,505,500 4/1996 Webb et al. ..... 137/375

*Primary Examiner*—A. Michael Chambers
*Attorney, Agent, or Firm*—Townsend and Townsend and Crew LLP

[57] ABSTRACT

An apparatus is described for the intermediate storage and control or release of a predeterminable quantity of water, wherein the predeterminable quantity of water is replenished, each time it has been released, from a supply main for the intermediate storage via an automatically acting supply valve arrangement. An elongate and substantially tubular container integratable into a wall construction is provided for the intermediate storage. This container is surrounded at least extensively by insulating material and is equipped at the outlet side with a valve which can be triggered to release the predeterminable quantity of water by means of an actuating element which can be installed at the container or at freely selectable distances from the container.

26 Claims, 6 Drawing Sheets

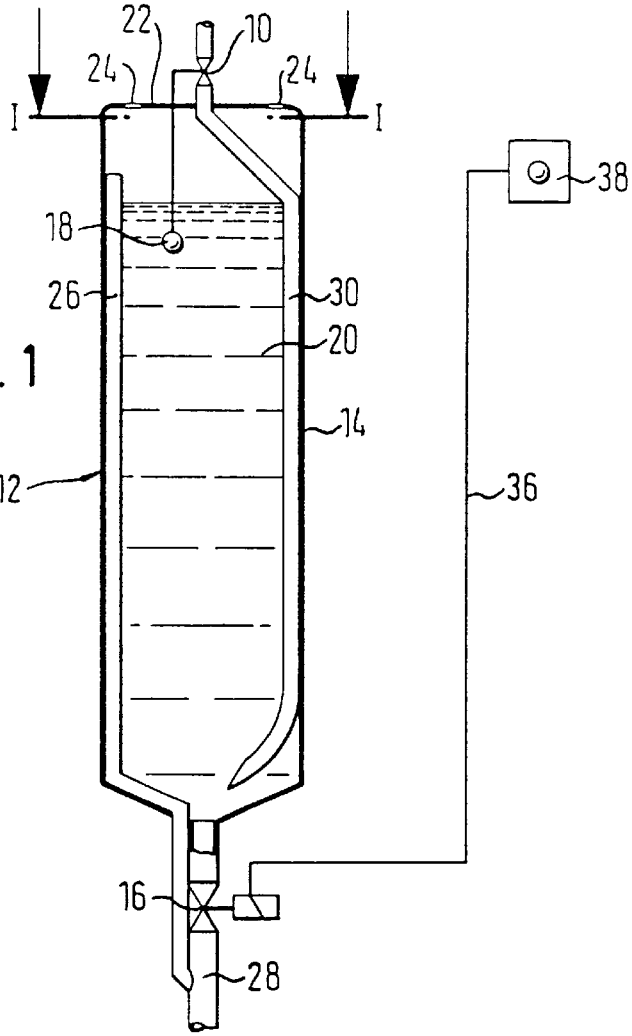
FIG. 1
FIG. 2
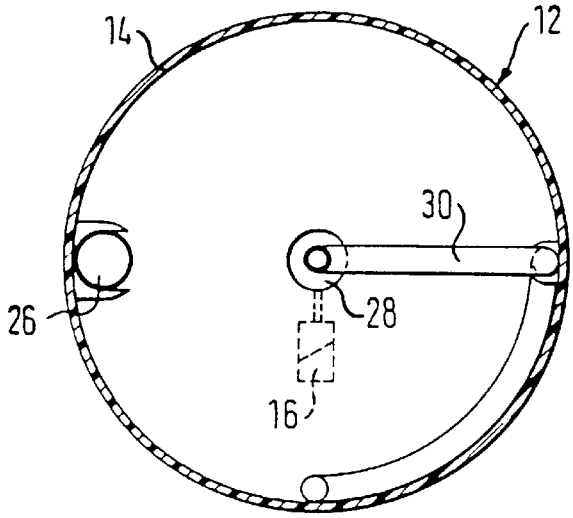

APPARATUS FOR THE INTERMEDIATE STORAGE AND CONTROLLABLE RELEASE OF A PREDETERMINABLE QUANTITY OF WATER

FIELD OF THE INVENTION

The invention relates to an apparatus for the intermediate storage and controllable release of a predeterminable quantity of water which, after each release, can be replenished again from a supply mains for intermediate storage via an automatically acting supply valve arrangement.

1. Description of Prior Art

Apparatus of this kind have been known for a long time in the form of flushing systems for toilet installations. These relatively voluminous flushing systems in the shape of a parallelepiped are either accommodated at a wall or, in the case of buried installation, in a wall construction. Despite these different types of installation nothing much has changed with respect to the design and function of this flushing system.

2. Object of the Invention

This invention is based on the object of providing an apparatus of the initially named kind which can be integrated in a space-saving and simple manner into a wall or shaft construction, while maintaining an ideal manner of operation, and which is above all capable of being insulated in a simple manner so that particularly good account can be taken of the requirements of noise reduction.

BRIEF DESCRIPTION OF THE INVENTION

The object underlying the invention is satisfied wherein an elongated and substantially tubular container integratable into a wall construction is provided for the intermediate storage and is surrounded, at least extensively, by an insulating material and equipped at the outlet side with a valve which can be triggered by means of a triggering element installable at the container or at freely selectable distances from the container for the release of the predeterminable quantity of water.

As a result of the elongated tubular shape of the container provided for the intermediate storage, not only is the respective space requirement reduced to a minimum, but the installation in front of a wall, in a wall, in the corner of a room or in an installation shaft can always be ideally matched to the pipe conduits which are in any case installed there. Thus, only a further length of pipe has to be installed alongside or between the normally installed pipe conduits and this length of pipe serves as a flushing water reservoir for a toilet installation and takes on the function of the previous flushing system.

Ideal insulation is also possible without problem, since the container no longer has the shape of a parallelepiped but is tubular.

In the preferred embodiment of the apparatus of the invention, the valve at the outlet side valve, which is preferably provided with a water brake for the valve closure delay, includes a valve member which can be lifted via a valve actuator and at least one and preferably two buoyancy members, which are arranged in the tubular container and are coupled to the valve actuator and—when two buoyancy members are used—are arranged above one another in the vertical alignment of the tubular container. The multi-stage buoyancy principle results in an ideal adaptation to the modified hydraulic conditions. The valve actuator can be executed in a preferred embodiment as a safety overflow pipe.

The tubular container can be walled in without a frame and is preferably held via at least one mounting which is decoupled with respect to structure-borne noise. A particularly advantageous mounting and holding in accordance with the invention is set forth in the subordinate claims and described in more detail further below in connection with an embodiment.

In order to achieve the best possible acoustic insulation, it is basically possible to use a tubular mounting device with a fixing clip and a support clip such as is described in DE-A-42 28 961.

The triggering of the valve at the outlet side can take place mechanically, electrically, electronically, pneumatically and/or in contact-free manner.

The trigger element which can be installed at the container or at freely selectable distances from the container can, for example, be arranged at the visible side of the wall construction. It can consist of a mechanical actuating button matched to the respective color of the sanitary fitting or of a sensor which is controlled electrically, electronically, or pneumatically and, in particular, in contact-free manner, which additionally simplifies the ever present requirement for acoustic insulation of the overall apparatus.

In one embodiment, the tubular container has a central length of tube and two cap pieces which can be pushed onto its ends, and into which the supply valve arrangement and the outlet valve arrangement are respectively integrated. This modular construction enables simple manufacture and installation in accordance with the modular principle and, if necessary, the problem-free exchange of the supply valve arrangement or of the valve at the outlet side. For this purpose it is only necessary to exchange the relevant cap piece.

A soft, composite, insulating material, which results in decoupling from structure-borne noise and consists of a plastic foil with an integrated tear resistant grid, a cushion layer of a fiber fleece and a plastic foam, can advantageously be provided as the insulating material. If a plurality of buoyancy members are used, one buoyancy member is expediently arranged in the region of the lower, outlet end and one buoyancy member is expediently arranged in the region of the upper end of the valve trigger or actuator.

The buoyancy member or members can consist of a lightweight material, such as in particular cork, polystyrene and/or the like. In an advantageous embodiment, the buoyancy member or members is or are formed by a preferably downwardly open, bell-like container containing an air cushion. A combination of the buoyancy members can also be used.

The outlet side valve can, for example, be a plate valve. In an expedient embodiment, the valve member of the outlet side valve is a buoyancy member, which can, for example, be of spherical shape.

The water brake which serves for the valve closure delay can be provided in the region of the lower buoyancy member, or also in the region of the upper buoyancy member. It can, for example, include a housing with a defined emptying bore.

In order to exploit the buoyancy of the valve actuator serving as an overflow pipe, the lower opening at the outlet side of the valve actuator is expediently provided in an advantageous embodiment with a preferably flap-like closure which is spring-loaded in the closing direction. The closure releases the opening as a consequence of the stagnation pressure of the water column which arises in the valve actuator in the event of damage.

In another advantageous embodiment, a special overflow passage is integrated into the tubular container.

The automatically acting supply valve arrangement can, for example, include a mechanically float-actuatable filling valve or also a solenoid valve which can be triggered electrically by a control with which a float switch is associated for the restriction of the filling level.

The tubular container is expediently provided with a releasable lid closure which, among other things, facilitates any servicing work that may possibly be necessary.

An installation frame, which is advantageously adapted to the respective inbuilt situation, is provided for the mounting and holding of the tubular container, of the flushing pipe, of a waste water connection bend and/or of a toilet mounting.

The most diverse inbuilt situations and shapes are conceivable, in particular as a consequence of the narrow tubular shape of the container and of the correspondingly small space requirement. Thus, the installation in a corner of a wall, and also installation in shafts or installation registers is possible. With installation in shafts, installation registers or in directly adjacent rooms the possibility exists of being able to spatially separate the apparatus of the invention and the corresponding means for receiving the quantity of water released, for example a toilet. This can be achieved by means of variable, smaller connection pipes or inflow fittings than was possible with the previously known flushing cisterns. The possibility of installation at a straight wall as already known per se is not precluded in this respect. Indeed, the previously customary and necessary provision of a front wall up to the top edge of the flushing system can be dispensed with by using installation cladding which covers over the region up to the top edge of the toilet bowl. It is, for example, possible to realize a cladding of this kind, of an exposed container installed in front of the wall, for example, by a cover hood which can be locked in place, with the shapes, colors and materials being selectable at will, so that new design possibilities result for interior design. Moreover, an adaptation to a desired bath design is, for example, also possible, if required.

Further embodiments of the apparatus of the invention are set forth in the subordinate claims.

BRIEF DESCRIPTION OF THE DRAWINGS

FIG. 1 is a schematic side view of an apparatus for the intermediate storage and controllable release of a predeterminable quantity of water, FIG. 2 is a cross-sectional view of the apparatus shown in FIG. 1, sectioned along line I—I of FIG. 1.

DETAILED DESCRIPTION OF THE PREFERRED EXEMPLARY EMBODIMENTS

Figure 3:
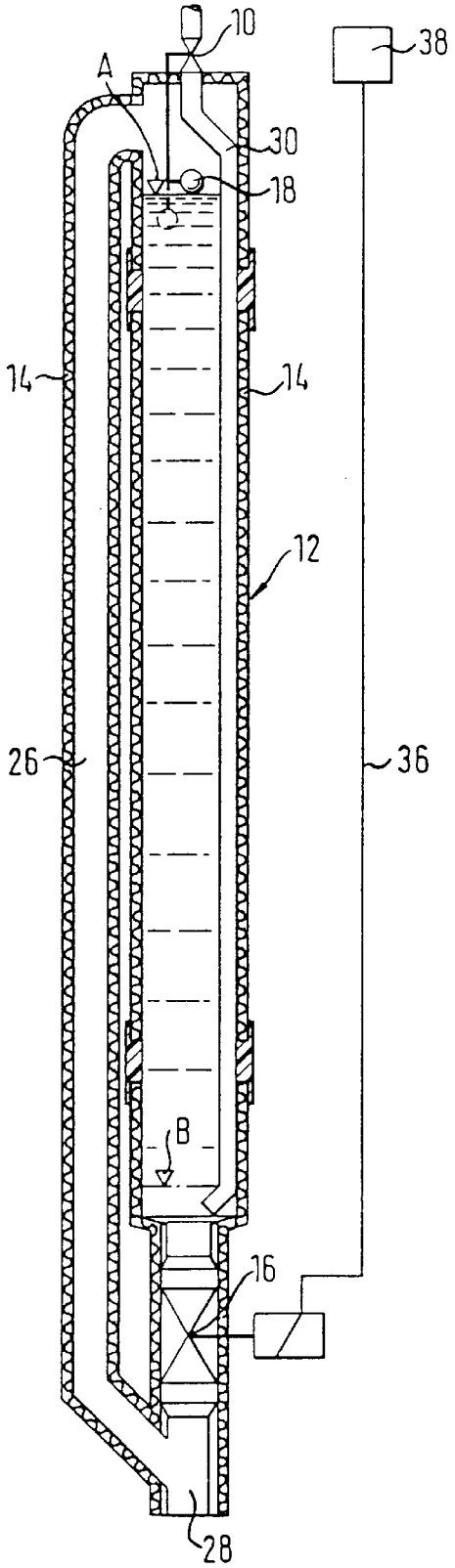
FIG. 3 is a schematic, longitudinally sectioned illustration of a further embodiment of the apparatus.

FIGS. 1 and 2 show in purely schematic form an apparatus for the intermediate storage and controllable release of a predeterminable quantity of water which, after each release has been completed, can be replenished via an automatically acting supply valve arrangement 10 from a supply mains for intermediate storage. An apparatus of this kind can, in particular, be used in connection with toilet devices. In this case, it satisfies the function of a flushing cistern.

For the intermediate storage this apparatus has an elongated and substantially tubular container 12 which can be integrated into a wall construction. This tubular container 12 is at least substantially surrounded by an insulating material 14 and is equipped at the outlet side with a valve 16 which can be triggered for the release of the predeterminable quantity of water.

In the present case the tubular container 12 has a circular cross-section (see FIG. 2). However, instead of a round cross-section it can also have an oval or polygonal cross-section. Moreover, a combination of these cross-sectional shapes is possible.

The supply valve arrangement 10 includes a filling valve which is controlled by a float 18. As soon as the water 20 contained in the container 12 has reached a predetermined maximum level, this filling valve is closed via the float 18.

The upper end wall 22 of the container 12 is provided with aeration and venting openings 24.

An overflow pipe 26 is secured to the inner side of the tubular container 12. Its lower end, which emerges from the container 12, opens into a flushing pipe 28.

A filling pipe 30 is, furthermore, secured to the inner side of the container 12 and is connected to the non-illustrated mains supply via the supply valve arrangement 10.

The outlet side valve 16 is a solenoid valve, which is connected via an electrical line 36 to a triggering element 38. The triggering element 38 can be arranged at the container 12 or at freely selectable distances from the container, preferably at the visible side of the wall construction, which accommodates the container 12 (not shown).

In the case of mechanical triggering, the trigger element 38 can also, in particular consist of a mechanical actuating button which is matched to the respective color of the sanitary fitting.

The elongate and substantially tubular container 12, which is capable of being integrated into the wall construction, is preferably arranged essentially axially parallel to pipe conduits or pipe runs present in the wall construction. It can be walled in without a frame and is preferably secured via a mounting which is decoupled with respect to structure-borne noise. For this purpose a pipe mounting device with a fixing clip and a support clip such as is described in DE-A-42 28 961 can advantageously be used.

The supply can also be regulated via another suitable filling level control, for example a solenoid valve, in place of a float controlled filling valve. The run-out mechanism which includes the valve 16 is preferably designed for a so-called abrupt emptying, for which purpose a customary run-out set with base valve can be used.

The embodiment shown in FIG. 3 is distinguished from the embodiment shown in FIGS. 1 and 2 substantially by an outer overflow pipe 26, the upper end of which opens into the supply side region of the tubular container 12. This overflow pipe 26 extends downwardly, at least substantially parallel to the tubular container 12, where it opens into the flushing pipe 28.

In this embodiment not only the tubular container 12, but also the overflow pipe 26 is at least substantially surrounded by an insulating material 14.

"A" designates the maximum water level, at which the supply valve arrangement 10 is closed via the float 18. The minimum water level is shown at "B".

In other respects the layout of this variant shown in FIG. 3 is substantially the same as the embodiment shown in FIGS. 1 and 2. The elements which correspond to one another are provided with the same reference numerals.

Figure 4:
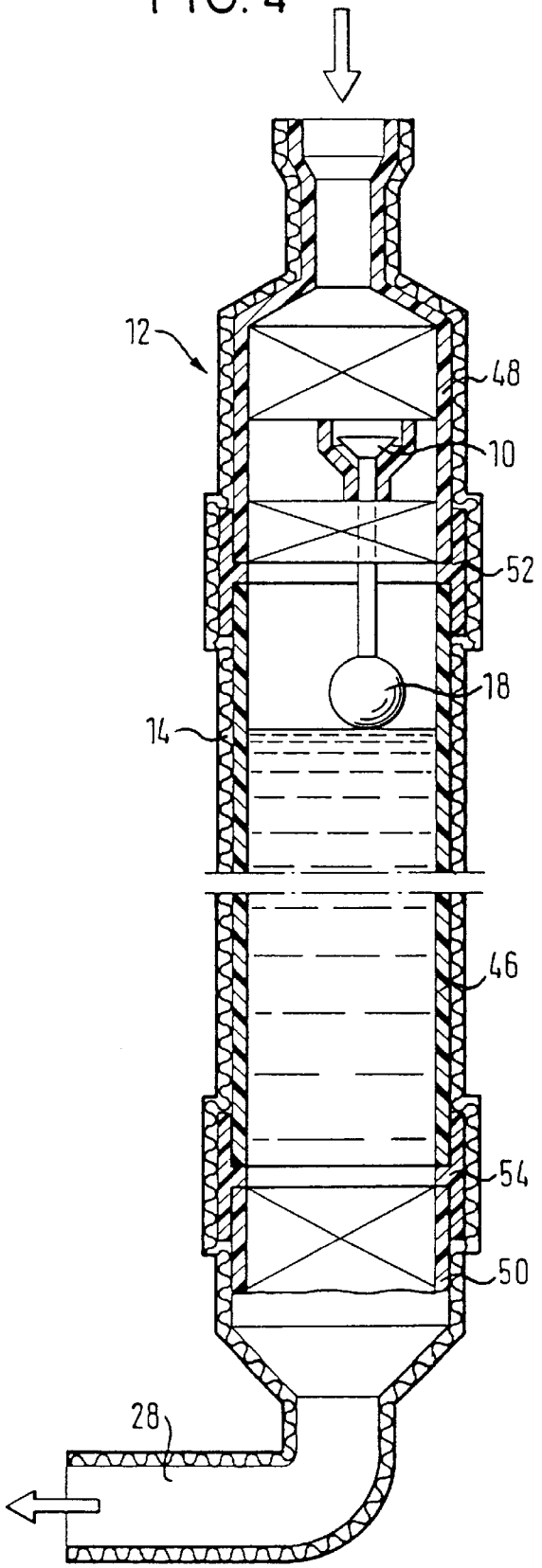
FIG. 4 is a schematic, longitudinally sectioned illustration of a further embodiment.

In the variant shown in FIG. 4 the tubular container 12 has a central tube piece 46 and two cap pieces 48, 50 which can be pushed onto its ends. The supply valve arrangement 10 is integrated into the supply side cap piece 48 and can, in particular, also include a water level limiter. The outlet side valve, or a corresponding run-out mechanism for abrupt emptying, is integrated into the cap piece 50 at the outlet side, which is, in addition, provided with a flushing pipe 28 with a suitable connection.

The cap pieces 48, 50 are connected via a respective muff connection 52, 54 with the central tube piece 46. In a further embodiment, which is not illustrated in detail, the cap parts 48, 50 can be simply welded to the central tube piece 46.

As can be clearly seen from FIG. 4, the total unit is surrounded by an insulating material 14, whereby a decoupling with respect to structure-borne noise is achieved throughout, from the wall construction and from the entire building.

A trigger element can be integrated into this embodiment in accordance with FIG. 4 into one of the cap pieces 48, 50.

Figure 5:
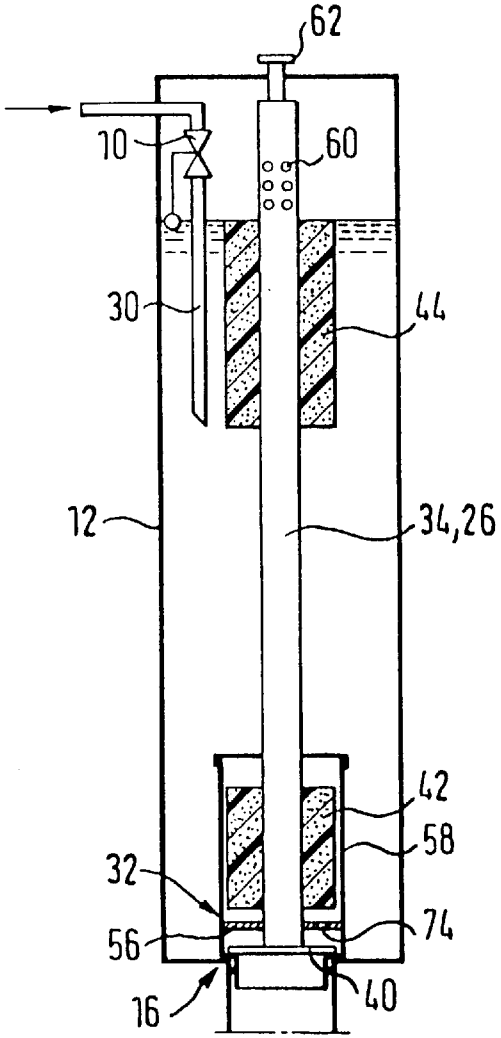
FIG. 5 is a schematic, longitudinally sectioned illustration of a further embodiment with a valve lifter serving as an overflow pipe and two buoyancy members.

FIG. 5 shows a schematic, longitudinally sectioned illustration of a further embodiment by way of example, having an outlet side valve 16 formed as a plate valve, with an associated water brake 32 to delay the valve closure and with a valve actuator 34 which simultaneously serves as an overflow pipe via which the plate like valve body 40 of the outlet side valve 16 can be lifted.

Two buoyancy members 42, 44 are attached to the valve actuator 34 and are arranged in the region of the lower outlet side end and in the region of the upper end of the valve actuator 34 respectively.

In the illustrated embodiment, the two buoyancy members 42, 44 consist of a lightweight material which can, for example, be cork, polystyrene and/or the like.

The water brake 32 provided in the region of the lower buoyancy member 42 and which serves for valve closure delay includes an intermediate base 56 of a valve housing 58, which is provided with a defined bore 74 and in which the lower buoyancy member 42 is arranged.

The valve actuator 34 which is formed as an overflow pipe is provided in the region of its upper end with radial overflow bores 60 above the upper buoyancy member 44.

A hand actuating element 62 projecting out of the container 12 is provided at the upper end of the valve actuator 34, which is coaxial to the tubular container 12. Via the actuating element 62, the actuator and thus the pipe-like valve member 40 can be lifted to release the stored quantity of water. The subsequent valve closure delay results from the fact that the water stored in the valve housing 58 flows away more slowly as a consequence of the intermediate base 56 with a defined bore 74 and the return of the valve member into its closed position is correspondingly delayed.

A filling pipe 30 fed via the automatically active supply valve arrangement 10 again projects into the container 12.

Figure 6:
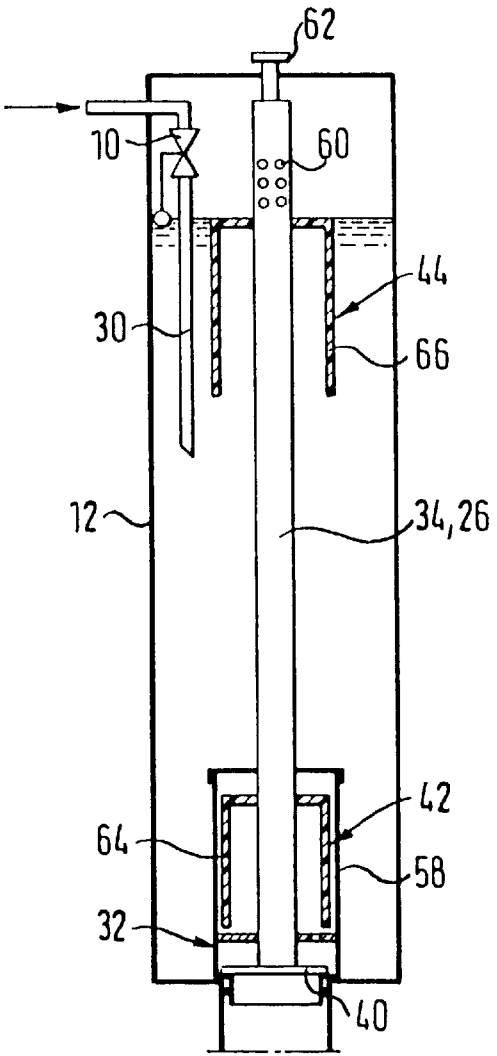
FIG. 6 is a schematic, longitudinally sectioned illustration of a further embodiment with two bell-like buoyancy members.

FIG. 6 shows a schematic, longitudinally sectioned illustration of a further advantageous embodiment which is distinguished from that of FIG. 5 substantially wherein both the lower buoyancy member and also the upper buoyancy member 42 and 44, respectively, are each formed by a downwardly open, bell-like container 64, 66 containing an air cushion. In other respects, this embodiment has the same basic design as that of FIG. 5, with the same reference numerals being associated with parts which correspond to one another.

Figure 7:
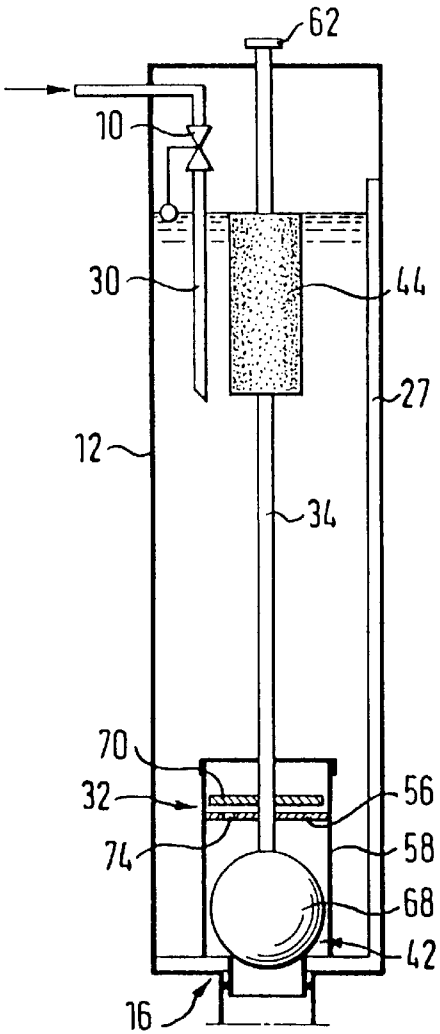
FIG. 7 is a schematic, longitudinally sectioned illustration of a further embodiment with a valve body which is simultaneously formed as a buoyancy member and with a special overflow passage.

In the embodiment of FIG. 7 the valve member 68 of the outlet side valve is simultaneously formed as a lower buoyancy member 42. In this case, it has a spherical shape.

The water brake 32 which serves for valve closure delay includes, in the present case, apart from the intermediate base 56 with a defined bore 74, a plate 70 which is fixedly connected to the valve actuator 34 and arranged above the intermediate floor 56 in the valve housing 68. The water stored in the region above the intermediate floor 56 in the valve housing 68 is pressed downwardly by the plate 70 through the defined bore 74 of the intermediate base 56 during the closing procedure.

In the present case, the valve actuator 34 is not formed as an overflow pipe. Instead, a special overflow passage or a special overflow pipe 27 is integrated into the tubular container 12.

In other respects, this embodiment has substantially the same basic design as that of FIG. 5 with parts which correspond to one another being provided with the same reference numerals.

Figure 8:
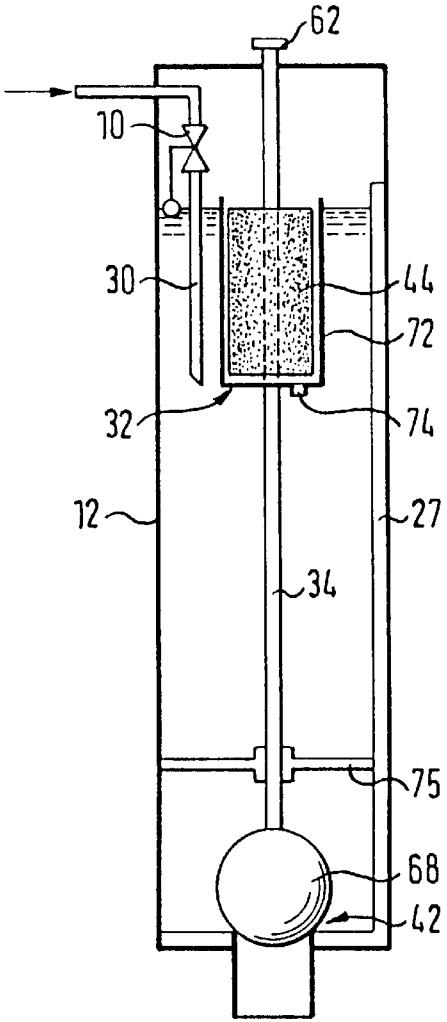
FIG. 8 is a schematic, longitudinally sectioned illustration of a further embodiment with a water brake arranged in the region of the upper buoyancy member.

FIG. 8 shows a further embodiment by way of example in which the water brake 32 which serves for valve closure delay is, however, provided in the region of the upper buoyancy member 44. This water brake 32 includes a housing 72 which receives the upper buoyancy member 44, with the base of the housing again being provided with a defined bore 74.

Above the spherical valve body 68, which simultaneously serves as the lower buoyancy member 42, a guide 76 for the valve actuator 34 is provided within the container 12. The valve actuator again serves as a pull rod.

In other respects, this embodiment has substantially the same basic construction as that of FIG. 7, with the same reference numerals again being associated with parts which correspond to one another.

Figure 9:
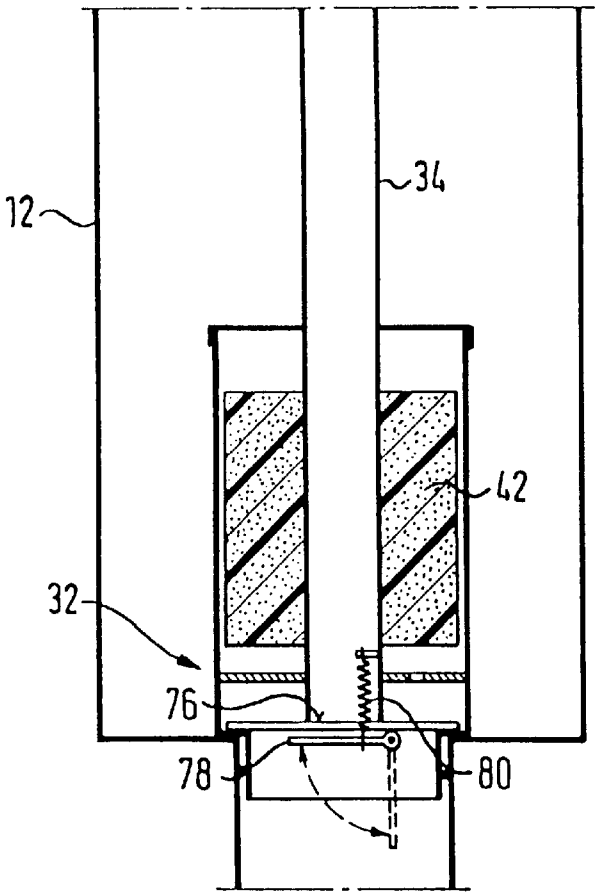
FIG. 9 is a schematic, longitudinally sectioned illustration of the lower part of a further embodiment with a valve lifter serving as an overflow pipe and with the lower opening of the valve lifter being provided with a flap-like closure.

FIG. 9 shows a schematic longitudinally sectioned illustration of the lower part of a further exemplary embodiment having a valve actuator 34 which serves as an overflow pipe and a water brake 32 associated with the lower buoyancy member 42 and serving for the valve closure delay.

In this embodiment, the lower, outlet side opening 76 of the valve actuator 34 is provided with a flap-like closure 78 which is loaded by a tension spring 80 in the closing direction and frees the opening 76 as a consequence of the stagnation pressure of the water column which arises in the valve actuator 34 in the event of damage. As long as no overflowing water has to be discharged, the buoyancy of the overflow pipe formed by the valve actuator 34 can thus also be exploited.

In other respects, this embodiment has substantially the same basic construction as that of FIG. 5, with parts which correspond to one another being provided with the same reference numerals.

Figure 10:
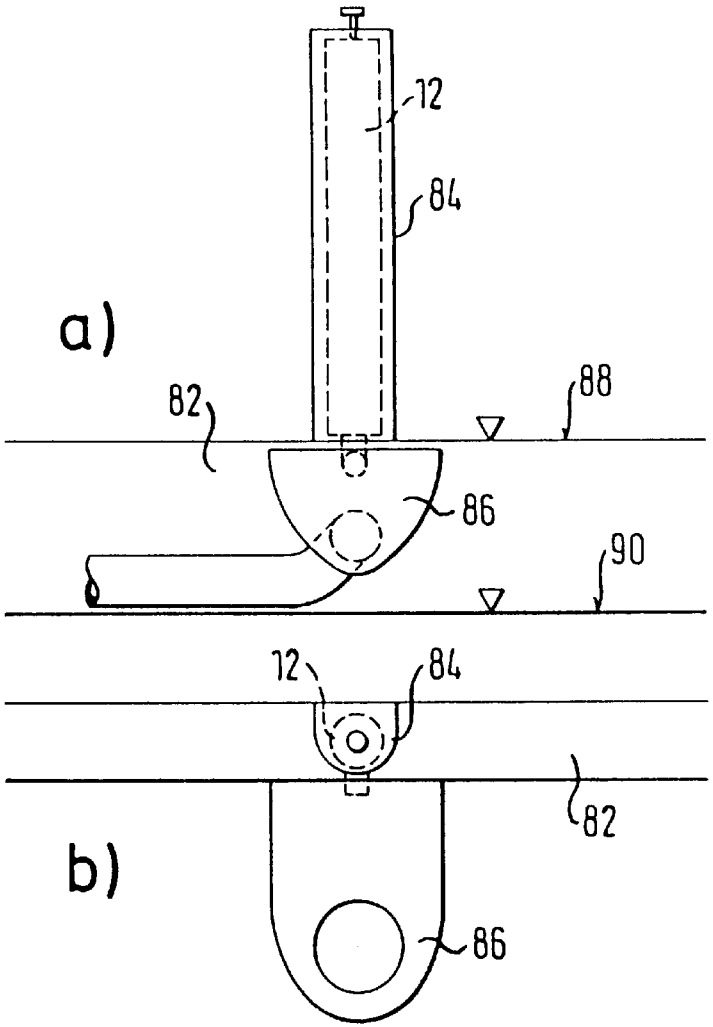
FIG. 10 is a schematic illustration of an inbuilt variant intended for a WC, with a front wall built in to WC height and a visible cover screen for the tubular container.

FIG. 10 shows in the upper part a) a schematic front view, and in the lower part b) a schematic plan view of an installation variant provided by way of example for a toilet. The toilet has a toilet height front wall 82 and a visible cover screen 84 for the tubular container 12. The cover screen 84 can be pushed over the tubular container 12 in the manner of a hood. The shape, the covering and also the materials of the cover screen 84 can be freely selected.

As can be seen with respect to the upper part a) of FIG. 10, the upper edge of the wall-suspended toilet bowl 86 only lies fractionally below the upper side 88 of the front wall 82. The upper side of the floor is designated in this drawing by 90.

Figure 11:
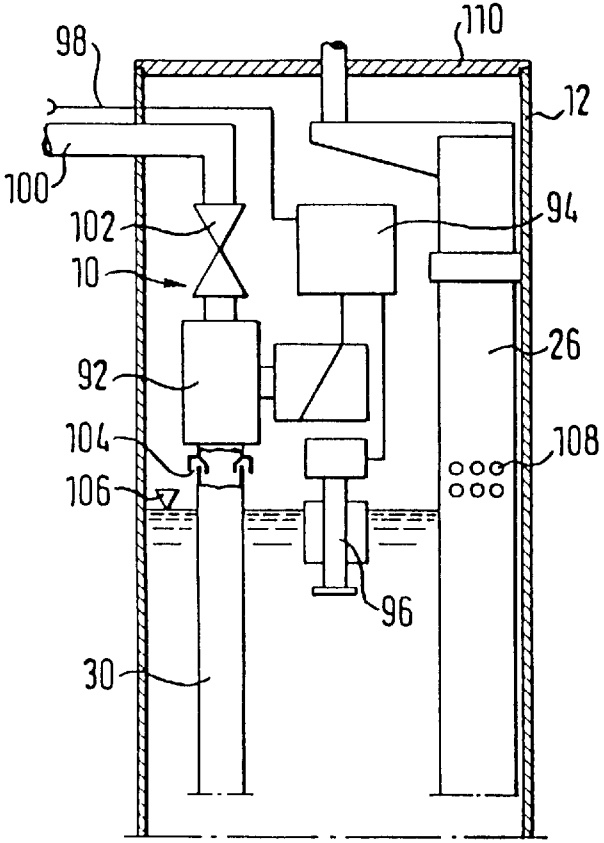
FIG. 11 is a schematic longitudinal sectional illustration of a further embodiment, in which the automatically acting supply valve arrangement is provided with an electrically actuated solenoid valve.

Whereas the automatically acting supply valve arrangement 10 is provided in the preceding embodiments with a filling valve which is mechanically float-actuated, FIG. 11 shows, again by way of example, a further embodiment, having an automatically active supply valve arrangement 10 which includes a solenoid valve 92, which is electrically triggerable via a control 94. A float switch 96 is associated with the control 94 to the level to which the container 12 is filled.

The current supply to the control 94 takes place via a line 98. The water supply which takes place via a pipe 100 can be shut off by a hand-actuated valve 102 arranged of upstream the solenoid valve 92 as seen in the flow direction. As can be seen with respect to FIG. 11, an aeration opening 104 is provided between the solenoid valve 92 and the filling pipe 30.

An overflow pipe 26 is again secured to the inner side of the tubular container 12. This overflow pipe 26 is provided with overflow bores 108 above the permissible filling level 106.

Moreover, the tubular container 12 has a releasable lid closure 110.

Figure 13:
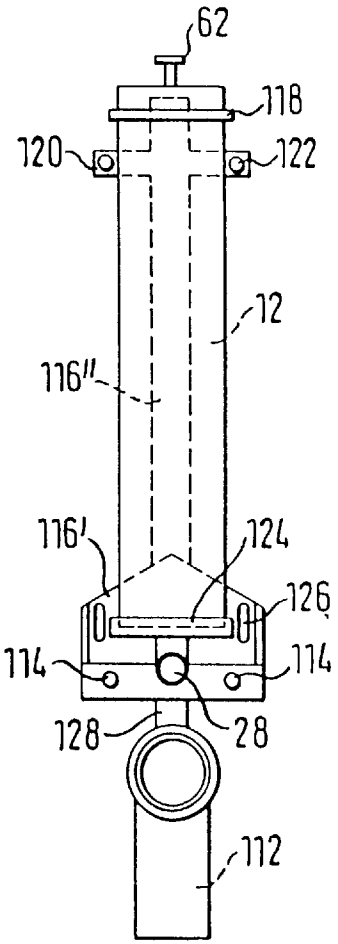
FIG. 13 is a schematic front view of the installation frame shown in FIG. 12.
Figure 12:
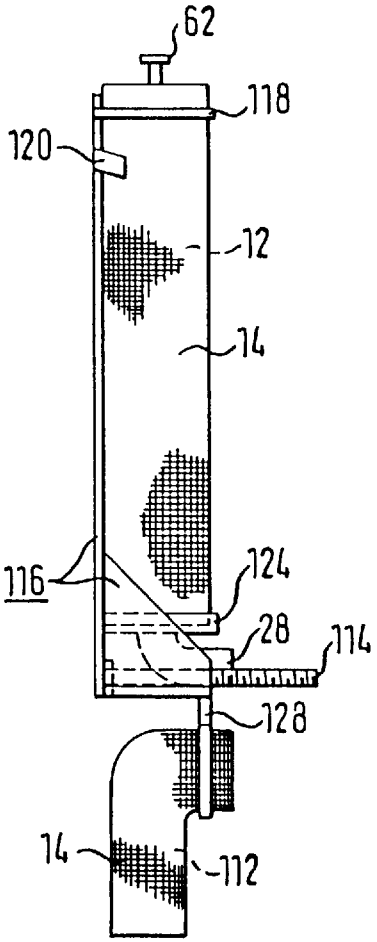
FIG. 12 is a schematic side view of an installation frame for the mounting and holding of the tubular container, of the flush pipe and of the waste water connection bend.

FIGS. 12 and 13 show in schematic side view and front view respectively an installation frame 116 for the mounting and holding of the tubular container 12, of a bent connection tube 28, of a waste water connection bend 112 and of two threaded bars 114 for the attachment of the relevant toilet bowl.

The tubular container 12 is secured to the upper end of the installation frame 116 by means of a clamping band or a releasable clip 118. Moreover, the installation frame 116 is provided in the region of this upper end with a lug 120 which is provided with openings for suitable wall attachment means 122.

In the lower region the installation frame 116 has a support 124 for the tubular container 12, by which this container 12 is simultaneously centered. The bent connection pipe 28 arranged beneath it is connected to the support 124. As can be seen with reference to FIGS. 12 and 13, the two threaded bars 114 extend on both sides of the connection pipe 28.

As can best be seen with respect to FIG. 13, the installation frame 116 includes a broadened pedestal-like lower part 116' and a narrower web-like part 116", which starts from and extends upwardly from the pedestal-like lower part 116'. Whereas the support 124 with the bent connection pipe 28 and the threaded bars 114 are provided in the region of the lower part 116', the lugs 120 and the tensioning band or releasable clip 118 are arranged at the upper end of the web-like part 116".

The lower part 116' is provided with elongate slots 126 for the attachment to the relevant wall.

A holder 128 for the waste water connection bend 112 is provided at the lower side of the pedestal-like lower part 116'.

Both the tubular container 12 and also the waste water connection pipe 112 are each provided with insulation 14.

Moreover, a hand-actuating element 62 which project upwardly out of the tubular container 12 can again be seen in these FIGS. 12 and 13.

The illustrated installation frame 116 is matched to the respective inbuilt situation and thus ensures a dimensionally accurate fixation of all toilet connection points.

In all embodiments, the tubular container 12 is expediently arranged substantially axially parallel to pipe conduits or pipe runs guided in the wall construction. A composite insulating material for the decoupling of structure-borne noise and consisting of a plastic foil with an integrated tear-resistant grid, a cushion layer of a soft fiber fleece and a soft plastic foam is advantageously provided as the insulating material 14. The tubular container 12 and/or the overflow pipes 26, 27 (see FIGS. 3, 7 and 8) can consist of plastic (PE, PP, PVC), casting (SML), steel or other materials. The diameter of the containers 12 which are preferably of circular cross-section can be selected in accordance with the sizes customary on the market (e.g. DIN 100, DIN 125, DIN 150). In the embodiment shown in FIG. 4 the central tube piece 46 can be a commercially available length of tube.

What is claimed is:

1. A flushing system for toilet installations, the flushing system comprising:

an elongated and substantially tubular container for storing water;

an automatically acting supply valve arrangement for providing water from a supply mains to the container;

a filling pipe secured at an inner side of the tubular container for providing water from the supply valve arrangement into the tubular container;

an outlet valve located on a lower end of the tubular container, the outlet valve being configured for triggering by a trigger element in order to release a predeterminable quantity of water from the container, the outlet valve including a water brake, a valve member liftable by a valve lifter and two buoyancy members arranged in the tubular container and coupled to the valve lifter, the two buoyancy members being arranged in series in a longitudinal direction of the tubular container and lying above one another with vertical alignment of the container; and an overflow pipe that opens into a flushing pipe below the outlet valve.

2. A flushing system in accordance with claim 1 wherein the overflow pipe is secured to the inner side of the tubular container.

3. A flushing system in accordance with claim 1 wherein the overflow pipe is external with respect to the tubular container.

4. A flushing system in accordance with claim 1 wherein one buoyancy member is arranged in a region of a lower outlet end and one buoyancy member is arranged in a region of an upper end of the valve lifter.

5. A flushing system in accordance with claim 1 wherein the tubular container is shaped to be one of round, oval, polygonal, or a combination thereof, in cross-section.

6. A flushing system in accordance with claim 1 wherein the tubular container may be arranged substantially axially parallel to pipe conduits guided in a wall construction or in an installation shaft.

7. A flushing system in accordance with claim 1 wherein the tubular container is walled-in without a frame and is held via at least one mounting decoupled with respect to structure-borne noise.

8. A flushing system in accordance with claim 1 wherein the outlet valve may be actuated by means of the trigger element one of either mechanically, electrically, electronically, pneumatically, without contact, or responding to a hydraulic pressure balance.

9. A flushing system in accordance with claim 1 wherein the actuating element may be installed at a visible side of a wall construction.

10. A flushing system in accordance with claim 1 wherein the trigger element consists of a mechanical actuating button matched to a respective color of sanitary fittings.

11. A flushing system in accordance with claim 1 wherein the trigger element consists of a sensor that is controlled one of either electrically, electronically, pneumatically, without contact, or by remote control.

12. A flushing system in accordance with claim 3 wherein the overflow pipe is at least substantially surrounded by insulating material and extends at least substantially parallel to the tubular container.

13. A flushing system in accordance with claim 1 wherein the tubular container includes a central tubular piece and two cap pieces in which there are integrated the supply valve arrangement and the outlet side valve, respectively, wherein the supply valve arrangement is integrated into a supply side cap piece that includes a water level limiter and an outlet side cap piece is provided with the flushing pipe that receives the released quantity of water.

14. A flushing system in accordance with claim 13 wherein the cap pieces are connectable via a respective muff connection with the central tubular piece.

15. A flushing system in accordance with claim 1 wherein at least one buoyancy member consists of a lightweight material.

16. A flushing system in accordance with claim 15 wherein the material consists of one of cork or polystyrene.

17. A flushing system in accordance with claim 1 wherein at least one buoyancy member is formed by a downwardly open bell-like container containing an air cushion.

18. A flushing system in accordance with claim 1 wherein the outlet valve is a plate valve.

19. A flushing system in accordance with claim 1 wherein a valve body of the outlet valve is simultaneously formed as a bouncy body.

20. A flushing system in accordance with claim 19 wherein the buoyancy body has a spherical shape.

21. A flushing system in accordance with claim 1 wherein the water brake comprises a housing with a defined emptying bore and is provided in a region of one of a lower buoyancy member or an upper buoyancy member.

22. A flushing system in accordance with claim 1 wherein either the valve lifter is simultaneously formed as an overflow pipe and is provided in a region of its upper end with radial overflow bores, with an outlet side lower opening of the valve lifter being provided with a flap-like closure that is spring biased in the closing direction and frees the opening as a consequence of the stagnation pressure of the water column arising in the valve lifter.

23. A flushing system in accordance with claim 1 wherein a special overflow channel is integrated into the tubular container and the actuation of the run-out side valve is realized by means of the valve lifter.

24. A flushing system in accordance with claim 1 wherein the automatically acting supply valve arrangement includes a mechanical float-actuatable filling valve.

25. A flushing system in accordance with claim 1 wherein a solenoid valve that can be triggered electrically by a control with a float switch is associated with the automatically acting supply valve arrangement for restriction of a filled level.

26. A flushing system in accordance with claim 1 wherein an insulation frame matched to a respective in-built situation is provided for mounting and holding of one of at least the tubular container, a connection pipe, a waste water connection bend, or a toilet bowl attachment.

* * * * *